United States Patent [19]

Glaser

[11] 4,367,826

[45] Jan. 11, 1983

[54] DISPENSING APPARATUS AND METHOD HAVING ABUTMENT STOP

[75] Inventor: Robert L. Glaser, Chicago, Ill.

[73] Assignee: Single Vend, Inc., Chicago, Ill.

[21] Appl. No.: 225,095

[22] Filed: Jan. 14, 1981

[51] Int. Cl.[3] ..... B65H 3/22

[52] U.S. Cl. ..... 221/213; 221/232

[58] Field of Search ..... 221/213, 214, 215, 216, 221/227, 232; 271/18.3

[56] References Cited

U.S. PATENT DOCUMENTS

| | | | |
|---|---|---|---|
| 1,622,262 | 2/1927 | Kindrat et al. . | |
| 3,917,114 | 11/1975 | Grosse . | |
| 4,216,877 | 8/1980 | Dutro . | |
| 4,296,873 | 10/1981 | Schlumpf | 221/213 |

*Primary Examiner*—Stanley H. Tollberg

*Attorney, Agent, or Firm*—Merriam, Marshall & Bicknell

[57] ABSTRACT

A method and apparatus for dispensing a single generally flat rectangular article having a penetrable surface from the top of a stack of the articles within an enclosure structure preferably of the coin-controlled type in which a spring-loaded vertically movable generally horizontally disposed elevator is provided for supporting a stack of the articles between an elevator platform and a pressure regulating abutment supported by a panel member pivotally attached to the enclosure structure at a level within the enclosure structure level where the article is to be dispensed. The pressure regulating abutment is adapted to move the panel member into a frictional holding engagement with the elevator when upwardly pressure is applied to the said abutment by the stack and hold the elevator stationary while a single laterally spaced article penetrating member engages the uppermost article in the stack at a point between the abutment and one lateral edge of the uppermost article so as to rotate the article in a horizontal plane and simultaneously moving the one lateral edge outwardly from the stack and project one corner of the article through an opening in the enclosure structure.

18 Claims, 6 Drawing Figures

FIG. 4
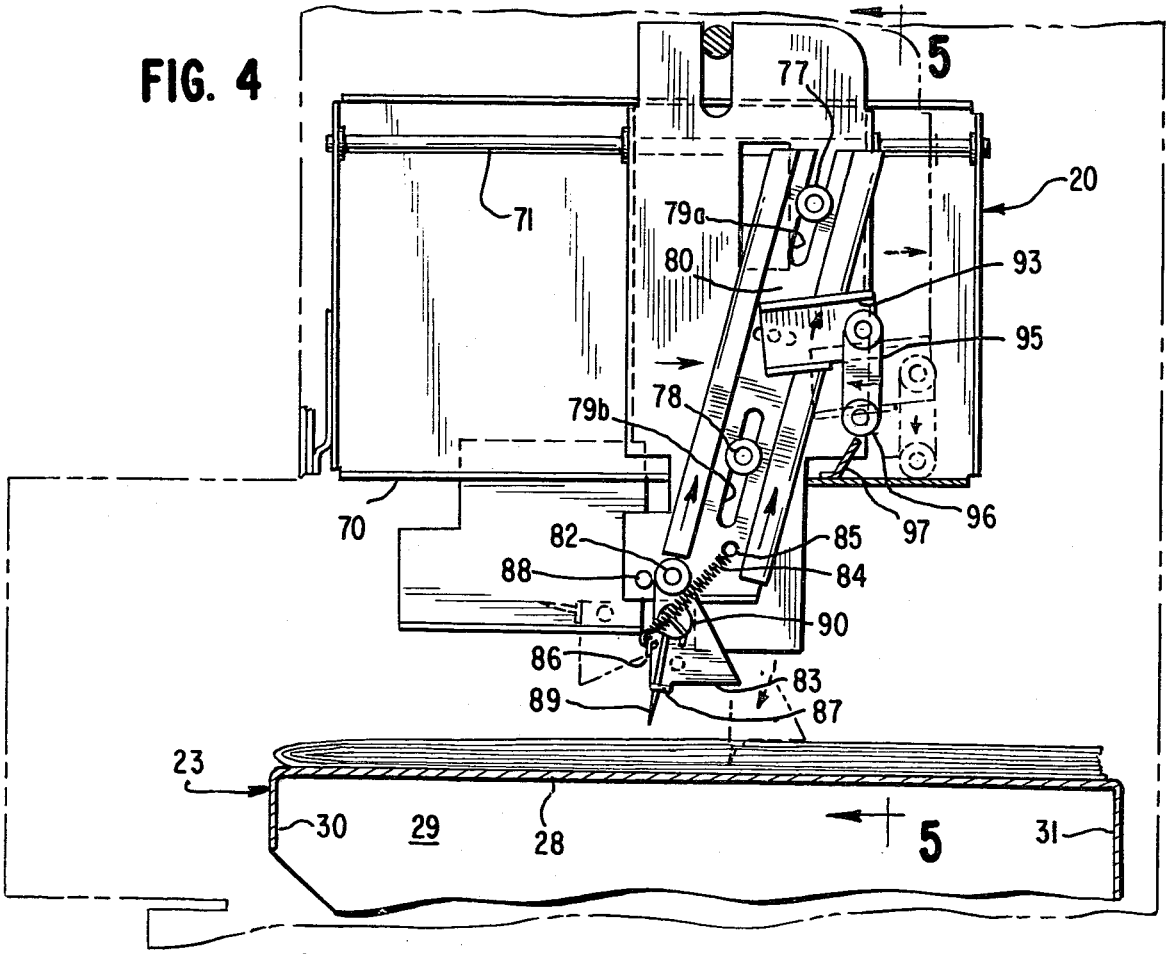
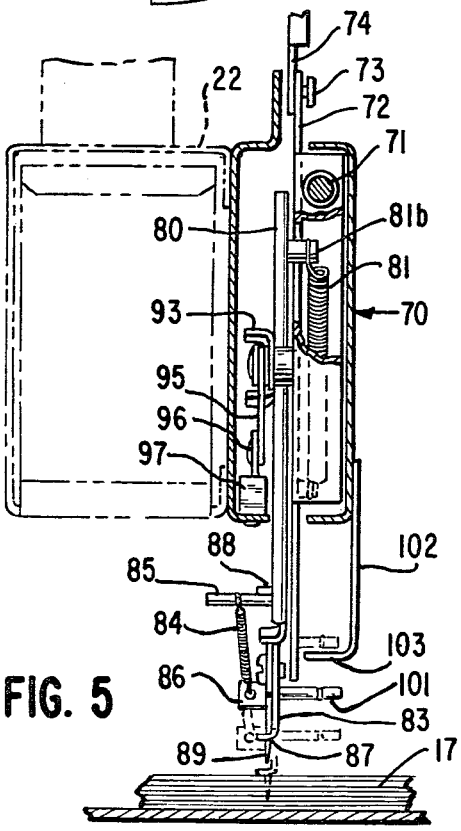
FIG. 5
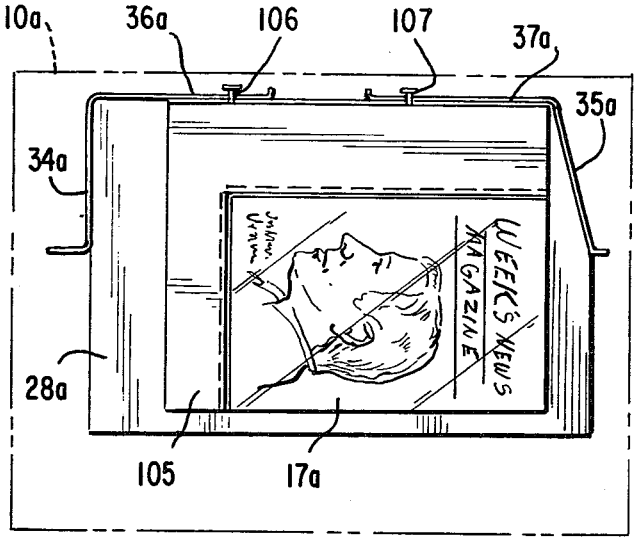
FIG. 6

DISPENSING APPARATUS AND METHOD HAVING ABUTMENT STOP

The present invention relates generally to a method and apparatus for dispensing an article one at a time from a stack of the articles, and more particularly to a method and apparatus for dispensing a single newspaper, magazine and like generally flat article from a coin-controlled vending machine.

In order to prevent the removal of two or more articles from a vending machine where insertion of a coin gives access to a stack of newspapers in the vending machine, it is desirable to provide a vending machine for newspapers and the like articles which will dispense only a single article from a stack of such articles within the machine in response to each coin controlled operation of the vending apparatus. While many such machines have been designed, there has been no entirely satisfactory vending machine of this type, because of difficulties encountered in ejecting only one article at a time, displacing or damaging the article being ejected, requiring special stacking arrangement of the articles, complex and expensive construction and substantial maintenance or repair expenses for the apparatus.

It is therefore an object of the present invention to provide an improved method of dispensing a single article from a stack of such articles from within an enclosure.

Another object of the invention is to provide an improved mechanism for dispensing a single article from a stack of such articles within an enclosure in response to each operation of the mechanism without opening the enclosure.

An additional object of the invention is to provide a dispensing apparatus for ejecting a single article from within an enclosure which is more economical to construct and requires less maintenance then previous apparatus for dispensing similar articles.

A further object of the invention is to provide a vending apparatus for dispensing newspapers folded in the usual manner which can be rapidly loaded and reloaded with newspapers or like articles to form a stack within the apparatus without regards to arranging the folded edge of the papers along the same side of the stack.

A still further object of the invention is to provide a vending type dispensing device for ejecting a corner portion of a single newspaper folded in the usual manner from the top of a stack of such articles into the delivery opening in the front of a vending device to permit the operator readily withdrawing the newspaper from the device without mutilation of the newspaper or displacing the remaining newspapers in the stack within the device.

Other objects of the invention will be apparent from the specification and claims to follow when read in conjunction with the accompanying drawing wherein;

FIG. 4 is a fragmentary vertical sectional view partially in elevation showing the dispensing mechanism of FIG. 3 in a different operative position;

FIG. 5 is a vertical sectional view partially in elevation taken along the line 5—5 of FIG. 4; and FIG. 6 is a schematic fragmentary view showing a modified form of the apparatus.

Figure 1:
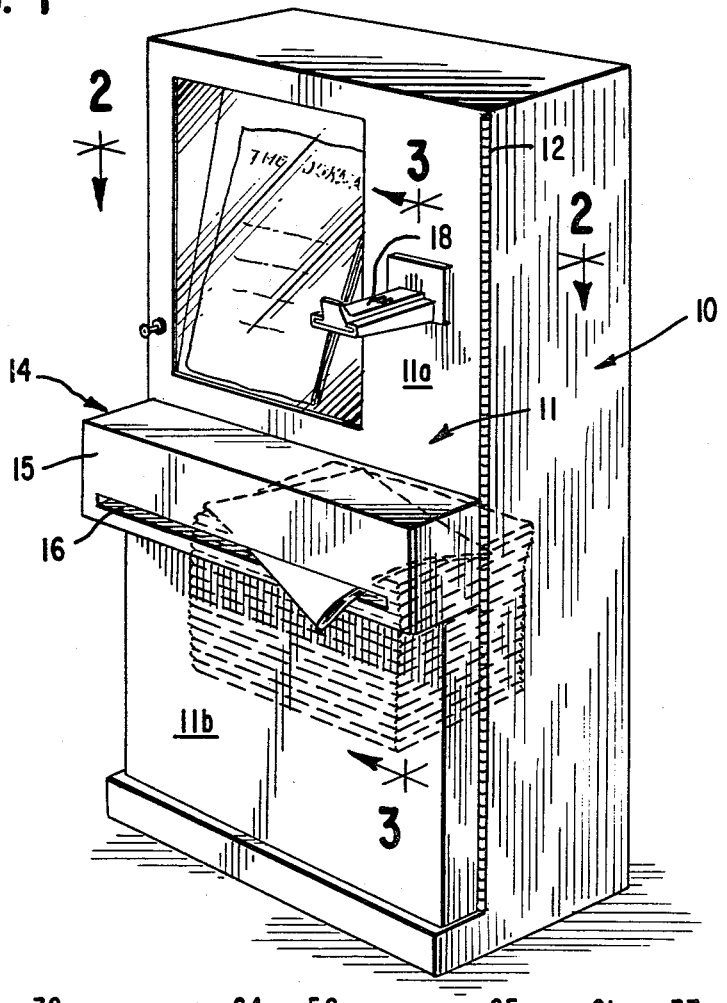
FIG. 1 is a perspective view of a vending apparatus employing the present invention.

In the drawing, particularly in FIG. 1, a vending machine cabinet 10 is shown having a front wall 11 hingably mounted at 12. The front wall 11 is preferably divided into an upper door section 11*a* and a lower door section 11*b*. The upper door section 11*a* is provided adjacent the lower end thereof with a forwardly extending enclosure 14 having a discharge passage or slot 16 in unobstructed communication with the interior of the cabinet 10 through which a corner portion of an article 17 is projected at the end of each operating cycle of the vending machine. Mounted integrally with the upper door section 11*a* and spaced above the enclosure 14 adjacent the hinged edge of the door section 11*a* is an outwardly extending horizontally reciprocable push-pull operating lever 18 having coin-receiving slots 19 formed therein and adapted for manually operating a dispensing mechanism 20. The dispensing mechanism 20 is securely mounted on the inner surface of the upper door section 11*a*. Coin controlled mechanism 21 is adapted to prevent the reciprocable movement of the operating lever 18 unless the proper type and amount of coins have been inserted in slots 19. A coil receiving cup 22 is provided below the inner end of the operating lever 18 within the cabinet 10.

A large rectangular passage is preferably formed in the front wall of the upper door section 11*a* to provide a display window for the article being dispensed in the apparatus. A display compartment behind the display window is formed by providing a narrow lower wall, a rearwardly and upwardly extending inner wall and truncated lateral walls 27 extending perpendicularly from the inner surface of the upper wall section 11*a*.

Figure 2:
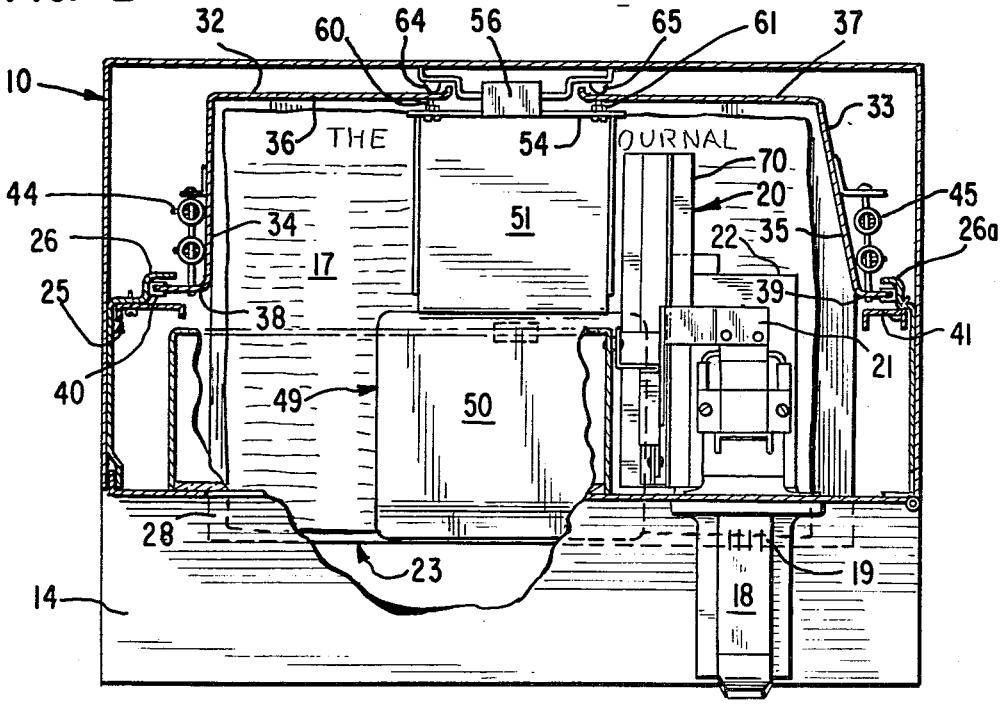
FIG. 2 is a horizontal sectional view taken along the line 2—2 of FIG. 1 with a portion of the apparatus broken away showing the arrangement of a dispensing mechanism embodying the present invention.
Figure 3:
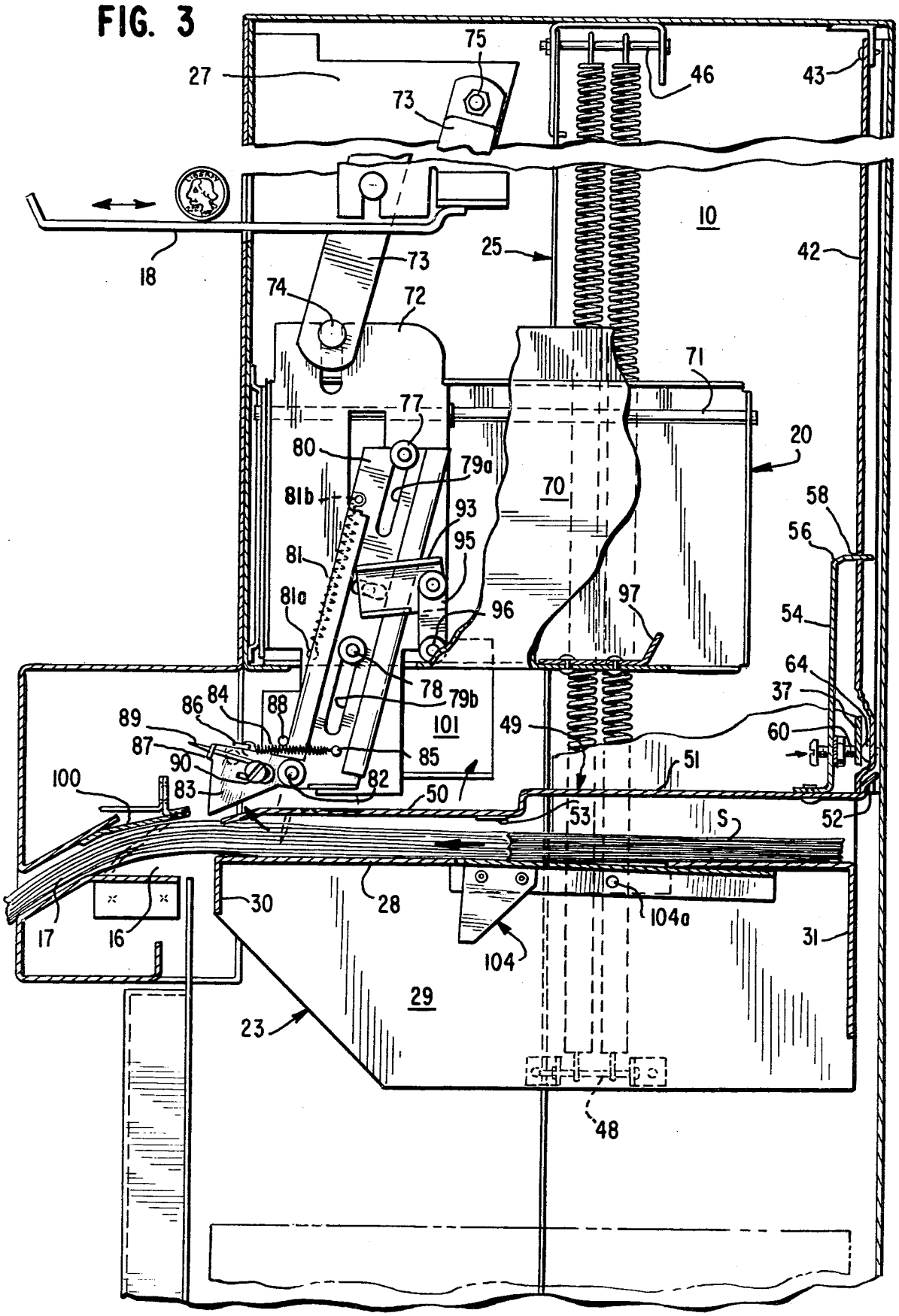
FIG. 3 is a vertical sectional view taken along the line 3—3 of FIG. 1 with a portion of the apparatus broken away to show the arrangement of the dispensing mechanism.

The arrangement within the cabinet 10 of the article dispensing or ejector mechanism 20 and the article positioning and supporting means 23 are best shown in FIGS. 2 and 3 of the drawing. The article positioning and supporting means 23 is preferably constructed in the form of a cartridge like assembly adapted for removable installation as a unit in the cabinet 10 and comprises a supporting frame 25 adapted to be secured by angular strips 26 and 26*a* to the cabinet 10 at a point intermediate the front and rear edges of the lateral walls of the cabinet 10. The article positioning and supporting means 23 is preferably spring loaded for vertical reciprocable movement along a vertical track in the frame 25 and comprises a generally rectangular horizontally disposed elevator platform or support member 28 having rigid depending lateral walls 29 and depending front and rear walls 30, 31, respectively. Article positioning sections 32, 33 are adapted to engage the inner corners of the articles and properly position the articles supported on the elevator platform 28. Each positioning section 32, 33 comprises lateral wall section 34, 35 which extend generally forwardly about half the depth of the elevator platform 28 and transversely extending rear wall sections 36, 37 preferably integral with the lateral wall sections 34, 35 with both wall sections being secured to the elevator platform 28. The lateral wall section 35 preferably forms an angle of about 105° with the rear wall section 37. Laterally extending flanges 38, 39 are formed at the forward edges of the lateral wall sections 34, 35. At points adjacent the upper and lower ends of said flanges 38, 39 guide means 40, 41 are mounted thereon which extend outwardly therefrom and which are adapted to form a sliding or rolling contact with the track formed by the angular strips 26, 26*a* and the frame 25, thereby enabling the article positioning and supporting means 23 to be readily moved vertically within the cabinet with minimal frictional resistance. Each rear wall section 36, 37 extends transversely across the rear of the elevator platform 28 less than half the length of the platform 28 so that the inner ends of each wall section 36, 37 are spaced. A narrow vertically extending generally channel shaped panel 42 is pivotally secured only at its upper end, as at 43, to the rear wall of the frame 25. The panel 42 is provided with lateral flanges along each vertical edge thereof with these lateral flanges extending behind the inner vertical edge portions of the rear wall section 36, 37. The channel shaped panel 42 is free to move in any direction between the rear walls and the frame.

The article positioning and supporting means 23 is yieldably supported for vertical reciprocable movement within the frame 25 by providing yielding means comprising a pair of coil springs 44, 45 having their upper ends secured, as at 46 in FIG. 3, to the upper edge of frame 25 and having their lower ends secured, as at 48 in FIG. 3, to the lateral flanges 29 of the elevator platform 28. The yielding means is adapted to provide an upwardly force slightly in excess of the force required to urge the articles supported on the elevator platform 28 upwardly when fully loaded with articles to be dispensed.

The upwardly movement of the article positioning and supporting means 23 is preferably limited and controlled by pressure regulating abutment brake means 49 which comprises a generally planar member 50 having a transversely extending strip of low friction material, such as a strip of Teflon ® plastic, attached to the lower surface of the abutment member 50 adjacent the inner edge thereof. The abutment member 50 also preferably has the outer most edge thereof turned slightly downwardly. A lever 51 extends rearwardly from the innermost edge of the abutment member 50 and preferably has upwardly extending lateral flanges to impart additional strength thereto. The innermost end portion of the arm 51 is provided with an upwardly and rearwardly extending flange 52 spaced equidistant inwardly from the lateral edges thereof. The lever arm 51 is also provided with an extension portion 54 which extends perpendicular to the plane of the arm 51 and is spaced a short distance forwardly of the inner end of the arm 51. The extension section 54 has a rearwardly extending flange 56 formed on the upper end of the section 54 spaced equidistant from the lateral edges thereof. The flange 52 is adapted to engage the lower end of the panel 42, and the flange 56 extends into a passage 58 formed in the panel section 42 spaced a distance above the lower end thereof so as to support the pressure regulating brake means 49 in a substantially horizontal position above the elevator platform 28 at a point opposite the discharge slot 16.

At spaced points adjacent the lower end of the extension section 54 and proximate each of the lateral edges thereof are provided rearwardly projecting rigid contact elements 60, 61 which are adapted to engage the inner surface of the rear wall section 36, 37, respectively, adjacent the inner edge portion thereof. Mounted on the lateral flanges of panel 42 directly opposite the ends of the rearwardly projecting contact elements 60, 61 of the pressure regulating brake means 49 are friction members 64, 65 which extend forwardly toward the rear surface of wall sections 36, 37. When the lever arm 51 is pivotably moved upwardly as the result of the abutment member 50 being urged upwardly by the stack of articles on the elevator platform 28, the flange 52 on the lever arm 51 engages the lower end of the panel 42 and draws the lower end of the panel 42 with said friction members 64, 65 forwardly into frictional engagement with the rear surface of the wall sections 36, 37, thereby preventing further upwardly movement of the elevator platform 28 and maintaining a consistent pressure on the uppermost article supported on the elevator platform 28. When upwardly pressure on the abutment member 50 is removed after a single article is removed from the stack of articles supported on the elevator platform 28 there is no longer sufficient friction between the wall sections 36, 37 and the friction member 64, 65 to prevent upwardly movement of the article supporting means 23, and the springs 44, 45 cause the elevator platform 28 to be moved upwardly a distance equal to the thickness of the uppermost article removed from the stack; whereupon the upwardly pressure of the stack on the abutment member 50 again causes the above described pressure regulating braking operation to take place.

The article dispensing ejector means 20 in the form disclosed in FIGS. 3 to 5 of the drawing comprises a housing 70 which is fixedly held on the inner surface of the upper door section 11*a*, and a guide rod 71 is provided in the housing 70 which extends horizontally spaced slightly below the upper wall of housing 70. A vertically disposed carrier plate 72 is reciprocably slidably mounted on the guide rod 71. A portion of the carrier plate 72 extends upwardly through a longitudinal passage formed in the upper surface of the housing 70 and is operatively connected at 74 with a lever arm 73 which is pivotably mounted at 75 on the lateral wall 27 of the article dispensing compartment supported on wall 11*a*. The lever arm 73 is operatively connected as at 21 with the reciprocably operating lever 18 of the coin control mechanism. The plate 72 and the parts associated therewith are adapted to be moved inwardly and outwardly within the housing 70 as the operating lever 18 is moved inwardly and outwardly during each complete cycle of the article ejecting mechanism.

The carrier plate 72 has an actuating plate 80 movable in a vertical plane supported thereon by spaced guide pins 77, 78 integral with plate 72 which slidably engage in spaced parallel slots 79*a* and 79*b* which limit the upwardly and downwardly movement of the actuating plate 80. The longitudinal axis of the actuating plate 80 forms an angle of about 15° with the vertical and is inclined rearwardly. The actuating plate 80 is normally held in a downwardly extending position by spring 81 having its lower end secured to the plate 72, as at 81*a*, and has its upper end secured to plate 72 by an anchor pin which extends through a slot in plate 72, as at 81*b*.

An off-center pivotal arm 83 is mounted on a pivot 82 integral with the plate 80 at a point adjacent the lower forward corner portion thereof. A spring 84 has one end thereof connected to the actuating plate 80, as at 85, and the other end connected to the pivotal arm 83, as at 86. The pivotal arm 83 is adapted to normally be maintained in the upwardly pivotal position as shown in FIG. 3. The off-center pivotal arm 83 is also provided with a tab 87 which extends perpendicular to the plane of the arm 83 on the foremost edge portion thereof which is provided with a passage therethrough for receiving a piercing element 89 securely held in position thereon, as at 90. The longitudinal axis of the piercing element 89 and the longitudinal axis of actuating plate 80 are preferably parallel when arm 83 is in the downwardly extending position.

The reciprocably movable actuating plate 80 has fixedly secured between the ends thereof a channel shaped link element 93 having one end extending rearwardly toward the back of the apparatus beyond the periphery of plate 80 with a finger 95 pivotably mounted on the outer end thereof. The finger 95 has a bearing element 96 on the outer end thereof which is adapted to engage the surface of cam 97 when the carrier plate 72 is moved rearwardly (from left to right in FIGS. 3 and 4 of the drawing) during the initial portion of the operating cycle of the article ejecting mechanism. When the finger 95 is moved rearwardly and into engagement with and travels upwardly along the inclined surface of cam 97, the finger 95 is moved pivotally rearwardly into contact with the flange on the lower edge of the channel shaped link 93 and causes the reciprocably movable actuating plate 80 to be moved upwardly. As the plate 80 is moved upwardly, the forward surface of arm 83 engages with pin 88 on the lower end of plate 72, causing the spring 84 to move across the pivot point 82 of the pivotal arm 83 and the spring 84 moves the arm 83 counter-clockwise into a downwardly extending position, as shown in full line of FIG. 4 of the drawing. And, as soon as the bearing element 96 passes over the upper end of cam 97 during the rearwardly movement of the plate 72, the actuating plate 80 is drawn rapidly downwardly by the force of spring 81 causing the piercing element 89 to penetrate the surface of the uppermost article in the stack. The piercing element 89 penetrates the surface of the uppermost article, such as a newspaper, to the maximum extent permitted by the tab 87. The piercing element penetrates the article at a forwardly inclined angle of about 15° with the vertical at a point spaced laterally of the abutment member 50 and preferably rearwardly of the midpoint between the front and rear edges of the article on the elevator platform 28.

While the article is being held between the abutment member 50 in an area about midway between the lateral edges of the article and preferably forwardly of the midpoint between the forward and rear edge thereof, the article is rotated about a pivot point which falls generally within the area of the article engaged by the abutment member 50 as a result of the outwardly movement (from right to left in FIGS. 3 and 4 of the drawing) of the carrier plate 72 along with the actuating plate 80, the pivotal arm 83 and the piercing element 89 in engagement with the article when the operating lever 18 is pulled outwardly to complete the operating cycle of the ejecting mechanism. Simultaneously with the above described pivotal movement of the article, one lateral edge of the article which is nearest the point thereof engaged by the piercing element 89 is moved outwardly until one corner of the article is projected through the discharge slot 16 beneath a protective flap 100 pivotally mounted in the discharge slot 16 so that the article can be manually withdrawn from the cabinet 10.

When an article, such as the newspaper 17, is manually withdrawn from the cabinet 10 after the completion of the ejection cycle, the pivotal arm 83 is moved in a clockwise direction from the downwardly projecting position as shown in full line in FIG. 4, to the upwardly directing position as shown in full line of FIG. 3. As the operator pulls the newspaper 17 outwardly with the piercing element 89 imbedded therein, the arm 83 is turned in a clockwise direction until the spring 84 crosses the pivot point 82 and thereafter the spring 84 holds the arm 83 in the upwardly extending position as shown in full line in FIG. 3. After the article is manually withdrawing from the cabinet 10, it is impossible to withdraw another article from the cabinet 10 without again actuating the coin controlled mechanism.

As a further tampering prevention mechanism, the apparatus is provided with means best shown in FIG. 5 which prevents an operator jarring the apparatus sufficiently to move the arm 83 with its piercing element 89 from the upwardly extending position to the downwardly extending position which is capable of making a piercing engagement with the article and withdrawing an article from the cabinet. To prevent the latter, a transversely extending pin 101 is provided on the arm 83 and a downwardly extending panel 102 having an inwardly extending flange 103 is secured to the outer surface of the housing 70 and extends a sufficient distance downwardly so that the flange 103 is disposed below the pin 101 when the arm 83 is in the upwardly extending position. When the apparatus is jarred sufficiently to move the arm 83 downwardly, the pin 101 contacts the inner surface of flange 103 and bounces upwardly preventing the arm 83 being moved to the downwardly extending position.

When all of the articles on the supporting platform 28 have been ejected as described herein, a counter balanced stop member 104 pivotally mounted at **104*a* on the under surface of the elevator platform 28 is pivotally moved upwardly through an opening formed in the elevator platform 28 directly in line with the travel of the plate 72 so that the coin controlled mechanism cannot be moved inwardly, thereby preventing coins being taken into the apparatus when there are no articles in the cabinet 10** available to be dispensed.

In order to reload the dispensing device with the articles to be dispensed the pressure regulating brake means 49 is disengaged from the panel 42 by depressing the elevator platform 28, the articles are stacked on the elevator platform 28 until the uppermost article in the stack is at a level slightly below the level of the lower end of the panel 42, and thereafter repositioning the pressure regulating break means 49 on the panel 42 so that the uppermost article in the stack engages the lower surface of the abutment member 50. The yielding means, such as the coil springs 46, 47, exert an upwardly force on the abutment member 50 sufficient to actuate the braking operation after overcoming the combined weight of the positioning and supporting means 23 and the articles stacked on the elevator platform 28. Generally, a pressure of about 2.5 pounds on the abutment member 50 is required to operate the braking operation.

While the article specifically referred to in describing the apparatus in FIGS. 1–5 has been a newspaper, it should be understood that the apparatus of the present invention can with minimal alterations be used for dispensing magazines, or similar articles. Thus, when the term "newspapers" is used in the description and claims, it should be understood that this term covers similar articles, including magazines, paperbacks, cartons and other packages which have a surface which can be penetrated by a piercing element without damaging the carton or the article contained therein.

FIG. 6 of the drawing is a schematic illustration of one means of transforming a dispensing device of the present invention from an apparatus suitable for dispensing newspapers to an apparatus suitable for dispensing magazines which comprises detachably mounting an L-shaped section 105 on the rear wall sections 36*a*, 37*a* of the elevator platform 28*a* by means of studs 106, 107 which engage in openings formed in the rear wall section 36*a*, 37*a*. The vertical walls of the L-shaped section 105 are adapted to engage the magazine 17*a* stacked on the elevator platform 28*a* so to position the article with their outer edges adjacent the outer edge of the elevator platform 28*a* and adjacent the lateral wall section 35*a* so that the article engaging and transport means engages the upper surface of the article between the area contacted by the abutment member (not shown) and one lateral edge of the article.

I claim:

1. In a device for dispensing a single article of a stack of generally flat articles through a discharge opening from within an enclosure;

a support frame, an elevator means mounted in said frame adapted for yieldable vertical reciprocable movement in said frame, said elevator means having vertically extending lateral wall sections, spaced vertically extending rear wall sections and a substantially horizontal platform section which is adapted to support a plurality of articles in the form of a vertical stack, a generally horizontally disposed abutment member supported by said frame substantially above the lower end of said frame opposite said discharge opening and extending into the interior of said enclosure, said abutment member being movably supported on the lower end portion of an elongated panel member pivotally connected at the upper end thereof to said frame and disposed between the inner ends of said spaced rear wall sections of said elevator means, said abutment member having contact means associated therewith at a point above the lower edge of said rear wall sections adapted to engage said rear wall sections when said abutment member is moved upwardly by the uppermost of said articles in said stack supported on said platform section being yieldably urged into engagement with the lower surface of said abutment member and forming a frictional engagement between said rear wall sections and said panel member which holds said elevator means against further upwardly movement relative to said frame until said uppermost article in said stack is moved out of engagement with said abutment member, and dispensing means supported within said enclosure for moving at least a portion of said uppermost article in said stack outwardly from the periphery of said stack while said elevator means is prevented being moved upwardly by said frictional engagement.

2. A dispensing device as in claim 1, wherein said panel member is provided with a friction element on the forward surface thereof directly opposite the point at which said contact means associated with said abutment means engages said rear wall section, and said abutment means has at its innermost end an upwardly extending flange adapted to pivotally engage the lower end of said panel member when said abutment member is moved upwardly causing said contact means to apply pressure on said rear wall sections and drawing said friction element into frictional engagement with said rear wall sections;

whereby further upwardly movement of said elevator means is prevented until said uppermost article in said stack is moved out of contact with said abutment member.

3. A dispensing device as in claim 1, wherein said dispensing means comprises an article engaging means which is reciprocably movable inwardly and outwardly over said stack of articles supported on said platform section in an area between said abutment member and one lateral edge of the uppermost article in said stack, said article engaging means adapted to be moved into releasably holding engagement with the upper surface of said uppermost article at a point spaced substantially inwardly from the front edge thereof when said dispensing means is at a maximum inwardly extending position, and said article engaging means when moved outwardly to a normally at rest position adapted to rotate said uppermost article about a pivot point falling in an area within about the periphery of said abutment member and moving one corner of said article outwardly beyond the periphery of said stack to facilitate removal of said uppermost article from said stack.

4. A dispensing device as in claim 1, wherein the wall sections of said elevator means extend upwardly from said platform the maximum heighth of said stack to provide guide means for said stack movable with said support section.

5. A dispensing device as in claim 1, wherein the said lateral wall section proximate said dispensing means forms an angle with said contiguous rear wall sections in excess of 90 degrees.

6. In a device for dispensing a single article of a stack of generally flat articles through a discharge opening from within an enclosure;

a support frame, an elevator means mounted in said frame adapted for yieldable vertical reciprocable movement within said frame, said elevator means having vertically extending lateral wall sections, vertically extending spaced rear wall sections and a horizontal platform section which is adapted to support a plurality of said articles in the form of a vertical stack thereon, an abutment stop means supported by said frame substantially above the lower end of said frame comprising an abutment member disposed within the area defined by said wall sections, a lever arm extending rearwardly therefrom provided with a flange section at the end thereof, an elongated panel member pivotally connected at the upper end thereof to said frame and extending between and behind the inner lateral edges of said spaced rear wall sections of said elevator means, and a support section extending upwardly from said lever arm movably connecting said lever arm with said panel member and maintaining said abutment member normally disposed generally horizontally at a point opposite said discharge opening, said flange section of said lever arm adapted to engage the lower end of said elongated panel member and move the lower end of said panel member toward said rear wall sections when said abutment member is moved upwardly, said panel member having spaced frictional contact means on the forward surface thereof adapted to engage said rear wall sections and form a frictional holding engagement with said rear wall sections when said abutment member is moved upwardly by the uppermost article in said stack on said platform section thereby preventing further upward movement of said elevator means relative to said discharge opening until said uppermost article is dispensed from said enclosure, and dispensing means supported within said enclosure adapted to move at least a portion of said uppermost article outwardly through said discharge opening while said elevator means is prevented being moved upwardly by said abutment stop means.

7. In a device for dispensing a single article from a stack of generally flat articles through a discharge opening from within an enclosure, a frame section, a generally horizontally disposed vertically movable platform means mounted within said frame section adapted to support a plurality of said articles in a stack thereon and moveable upwardly by yieldable means, an abutment stop means supported by said frame section having an abutment member disposed opposite said discharge opening and adapted to be engaged by the uppermost articles in said stack and prevent further upward movement of said platform means, a reciprocably movable article engaging and transport means supported in said frame section having an article penetrating means pivotally mounted above said abutment member and spaced laterally of said abutment means, said article penetrating means adapted for movement into releasable penetrating engagement with the upper surface of said uppermost article at a point spaced laterally of said abutment stop means, said article engaging and transport means comprising a carrier plate mounted for reciprocable movement across said platform means in a plane generally perpendicular to a rear wall of said enclosure, an actuating plate mounted on said carrier plate for yieldable reciprocably movement in a plane generally perpendicular to the plane of said platform means and having said article penetrating means pivotally mounted adjacent the lower end of said actuating plate with said penetrating means normally pivotally disposed in a forwardly extending position, said actuating plate adapted to be moved upwardly from a normal lower reciprocable position against the downwardly force of a tension means by slidably contacting a fixed caming surface as said carrier plate is moved into a maximum inwardly reciprocable position, means on said carrier plate coacting with said actuating plate for pivotally moving said article penetrating means into downwardly extending position when said actuating plate is moved upwardly, and said tension means effecting movement of said penetrating means into said penetrating engagement with the uppermost article in said stack when said carrier plate is moved into a maximum inwardly reciprocable position, and said article engaging and transport means adapted to rotate said article in a horizontal plane and move only one corner of said uppermost article outwardly beyond the periphery of said stack through a discharge opening in said enclosure when said carrier plate is moved to a maximum outwardly reciprocable position.

8. A dispensing device as in claim 7, wherein said means on said carrier plate which coacts with said actuating plate to pivotally move said article penetrating means is a spring biased off-center pivotal arm adapted to hold said penetrating means in said forwardly extending position until said actuating means is moved upwardly by coaction with said caming surface.

9. A dispensing device as in claim 8, wherein said pivotal arm is adapted to be pivotally moved to said forwardly extending position by said article being withdrawn from said enclosure.

10. A dispensing device as in claim 7, wherein said article engaging and transport means is actuated reciprocably by a coin controlled operating means.

11. In a device for dispensing a single article from a stack of generally flat articles supported horizontally within an enclosure between a vertical movable platform means mounted within said enclosure and an article stop means disposed opposite a discharge opening of said enclosure, an improved article engaging and transport means for dispensing a said single article from said enclosure through said discharge opening comprising; a carrier plate mounted within said enclosure for reciprocable movement over said platform means in a plane generally perpendicular to a rear wall of said enclosure, an actuating plate mounted on said carrier plate for yieldable reciprocably movement in a plane generally perpendicular to the plane of said platform means and having an article penetrating means pivotally mounted adjacent the lower end of said actuating plate with said penetrating means normally pivotally disposed in a forwardly extending position, said actuating plate adapted to be moved upwardly from a normal lower reciprocable position against the downwardly force of a tension means by slidably contacting a fixed caming surface as said carrier plate is moved into a maximum inwardly reciprocable position, means on said carrier plate coacting with said actuating plate for pivotally moving said article penetrating means into downwardly extending position when said actuating plate is moved upwardly, and said tension means effecting movement of said actuating plate downwardly and moving said penetrating means into a penetrating engagement with the uppermost article in said stack when said carrier plate is moved into a maximum inwardly reciprocable position, and said article engaging and transport means adapted to move at least one corner of said uppermost article outwardly beyond the periphery of said stack through a discharge opening in said enclosure when said carrier plate is moved to a maximum outwardly reciprocable position.

12. A dispensing device as in claim 11, wherein said support section is provided with spaced rigid contact elements extending rearwardly to said spaced rear wall sections adjacent the lower end thereof and disposed opposite said spaced frictional contact elements.

13. A dispensing device as in claim 11, wherein said means on said carrier plate which coacts with said actuating plate to pivotally move said article penetrating means into said downwardly extending position is a spring biased off-center pivotal arm adapted to hold said penetrating means in said forwardly extending position until said actuating means is moved upwardly by coaction with said caming surface.

14. A dispensing device as in claim 13, wherein said pivotal arm is adapted to be pivotally moved to said forwardly extending position by said article being withdrawn from said enclosure.

15. A dispensing device as in claim 11, wherein said article engaging and transport means is actuated reciprocably by a coin controlled operating means.

16. In a vending device for dispensing a single article of a stack of generally flat articles through a discharge opening from within an enclosure, a frame section, a generally horizontally disposed vertically movable platform means mounted within said frame adapted to support a plurality of said articles in a stack thereon and movable upwardly by yieldable means, an abutment stop means supported by said frame section opposite said discharge opening and adapted to engage at about the midpoint the uppermost of said articles in said stack when said stack is yieldably moved upwardly, reciprocable article engaging and transport means disposed above said platform means having an article penetrating means mounted for pivotal and vertical reciprocable movement disposed above and laterally of said abutment stop means, said article engaging and transport means reciprocably movable in a plane perpendicular to a rear wall section of said enclosure and said article penetrating means adapted to be moved into releasable penetrating engagement with the upper surface of said uppermost article by the reciprocable movement of said article engaging and transport means into an extreme inward reciprocable position, and said article engaging and transport means adapted to pivotally rotate said uppermost article of said stock in a horizontal plane while said article is engaged by said abutment stop means and eject only one corner of said article outwardly beyond the periphery of said stack through said discharge opening when said article engaging and transport means is moved to an extreme outwardly reciprocable position.

17. In a dispensing device for dispensing a single article of a stack of generally flat articles through a discharge opening from within an enclosure, means for maintaining a stack of generally flat rectangular penetrable articles on a generally horizontally disposed spring loaded support means, an abutment stop means having an abutment member disposed above said support means within said enclosure opposite said discharge opening therein adapted to be contacted by the uppermost article in said stack in an area about equidistant from the opposite lateral edges of said uppermost article and forwardly of the midpoint between the front and rear edges of said uppermost article, means for engaging said uppermost article with an article penetrating element at a point rearwardly of said midpoint and between said abutment stop member and one lateral edge of said article, and means for moving said penetrating element in a plane perpendicular to a rear wall of said enclosure in an outwardly direction relative to said stack to pivotally rotate relative to said abutment member said uppermost article in a generally horizontal plane while said article is in engagement with said abutment member and effect moving only one corner of said article outwardly beyond the periphery of said stack through said discharge opening.

18. A method of dispensing a single article through a discharge opening in an enclosure containing a plurality of generally flat articles comprising, arranging a plurality of said articles one upon another in the form of a verticle stack on a yieldable support means within said enclosure, positioning an abutment stop means having an abutment member disposed above said support means opposite said discharge opening, moving said support means with said stock upwardly until the uppermost article in said stack is yieldably urged into contact with said abutment stop means which is adapted to prevent further upwardly movement of said stack, engaging the uppermost article in said stack with an article penetrating and transport means at a point spaced substantially inwardly of the front edge of said support means and stack between one lateral edge of said uppermost article and said abutment member, and moving said article penetrating and transport means outwardly in a plane perpendicular to the rear wall of said enclosure to effect rotating said uppermost article relative to said abutment member and effect moving said one lateral edge outwardly until only one corner of said uppermost article extends outwardly beyond the periphery of said stack through said discharge opening sufficiently to facilitate removal of said uppermost article from said enclosure.

* * * * *